US008902678B2

(12) United States Patent
Dimartino et al.

(10) Patent No.: US 8,902,678 B2
(45) Date of Patent: Dec. 2, 2014

(54) VOLTAGE REGULATOR

(75) Inventors: Alberto Jose' Dimartino, Palagonia (IT); Antonino Conte, Tremestieri Etneo (IT); Maria Giaquinta, Catania (IT); Giovanni Matranga, Catania (IT)

(73) Assignee: STMicroelectronics S.R.L., Agrate Brianza (MB) (IT)

( * ) Notice: Subject to any disclaimer, the term of this patent is extended or adjusted under 35 U.S.C. 154(b) by 464 days.

(21) Appl. No.: 13/405,619

(22) Filed: Feb. 27, 2012

(65) Prior Publication Data

US 2012/0218837 A1 Aug. 30, 2012

(30) Foreign Application Priority Data

Feb. 28, 2011 (IT) ..... MI2011A0306

(51) Int. Cl.
*G11C 5/14* (2006.01)
*G05F 1/575* (2006.01)

(52) U.S. Cl.
CPC ..... *G05F 1/575* (2013.01)
USPC ..... 365/189.09; 365/189.06; 365/189.14; 365/230.06

(58) Field of Classification Search
CPC ..... G11C 5/147; G11C 8/08; G11C 11/4074; G11C 16/30; G11C 7/00; G11C 7/10; G11C 16/12; G11C 5/145
USPC ..... 365/189.03, 189.14, 189.06, 189.09, 365/189.08, 205, 207, 230.05, 230.06
See application file for complete search history.

(56) References Cited

U.S. PATENT DOCUMENTS

| | | | | |
|---|---|---|---|---|
| 5,945,819 | A | 8/1999 | Ursino et al. | |
| 6,157,176 | A | 12/2000 | Pulvirenti et al. | |
| 7,714,553 | B2 | 5/2010 | Lou | |
| 7,728,569 | B1 | 6/2010 | Le et al. | |
| 2002/0118568 | A1 * | 8/2002 | Tanzawa | 365/185.11 |
| 2003/0098674 | A1 | 5/2003 | Ostrom | |
| 2009/0237048 | A1 | 9/2009 | Hou et al. | |
| 2010/0201332 | A1 * | 8/2010 | Le et al. | 323/280 |

FOREIGN PATENT DOCUMENTS

| | | | |
|---|---|---|---|
| EP | 1569062 | A1 | 8/2005 |
| EP | 1806640 | A2 | 7/2007 |

* cited by examiner

*Primary Examiner* — Hien Nguyen
(74) *Attorney, Agent, or Firm* — Allen, Dyer, Doppelt, Milbrath & Gilchrist, P.A.

(57) ABSTRACT

A voltage regulator may include an input terminal for receiving an input voltage and an output terminal for providing a respective output voltage, a regulation transistor having a first conduction terminal coupled to the input terminal for receiving the input voltage, a second conduction terminal coupled to the output terminal, and a control terminal coupled to the output of a first operational amplifier. The first operational amplifier may have a non-inverting input terminal for receiving a first reference voltage, and an inverting input terminal coupled to a first terminal of a divider circuit for receiving a second reference voltage.

23 Claims, 11 Drawing Sheets

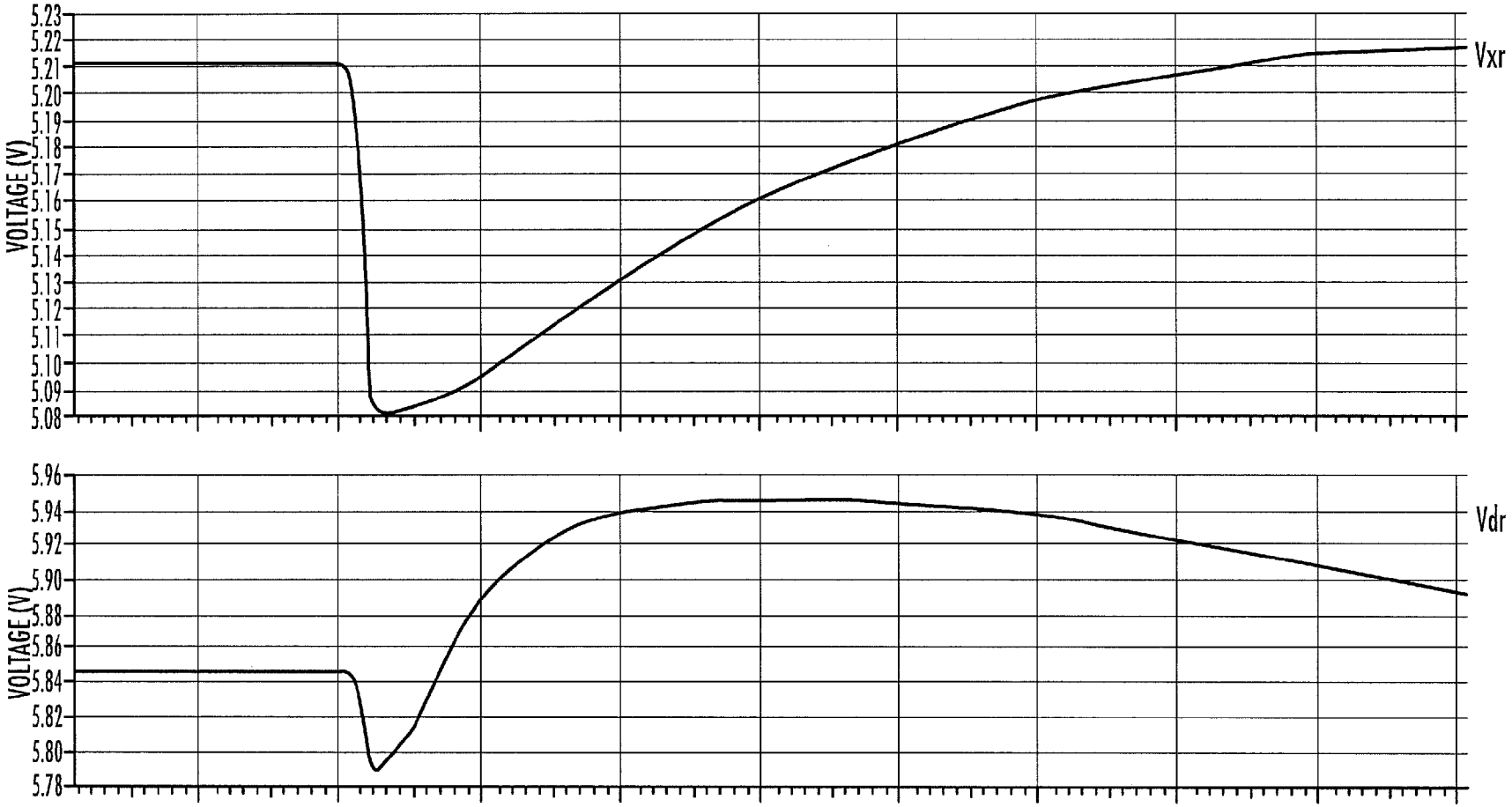
FIG. 4A.1

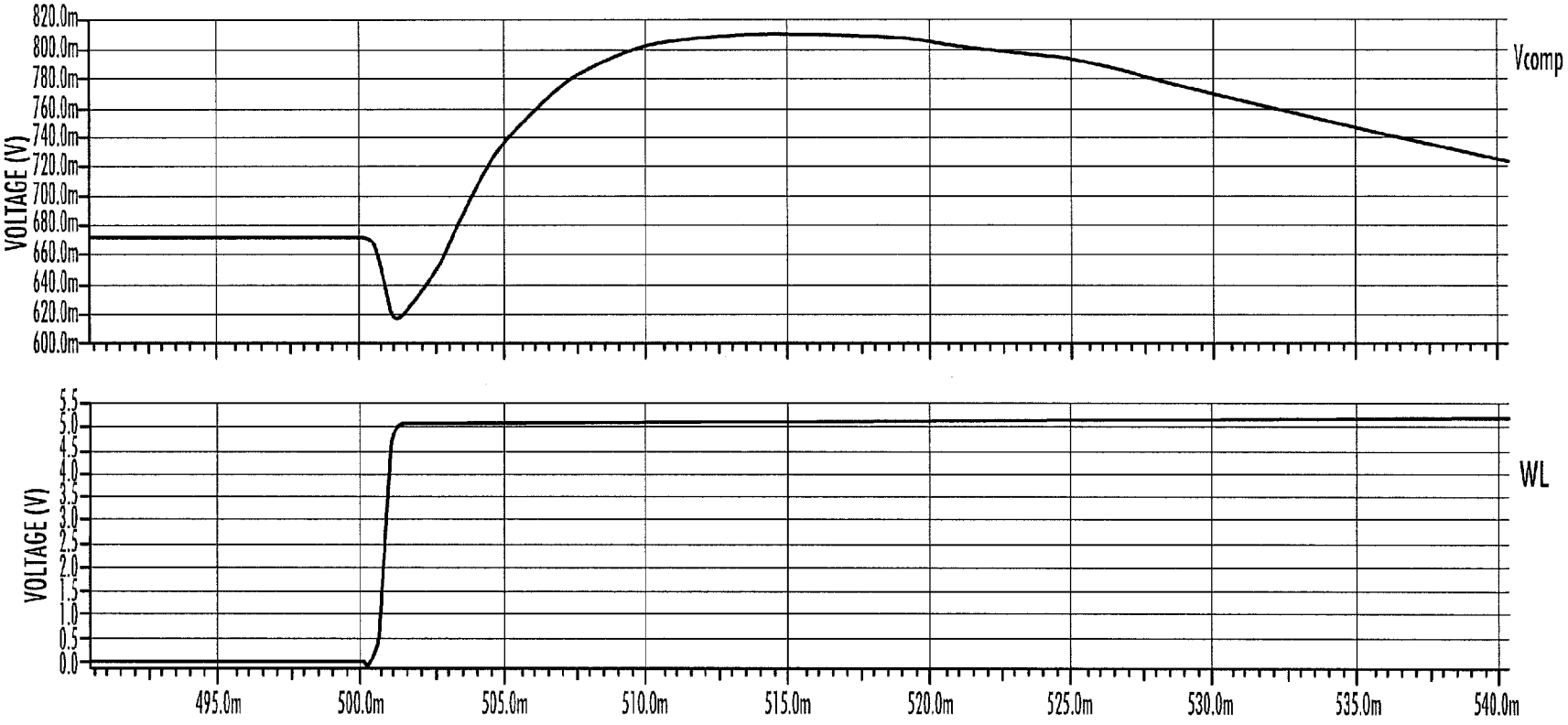
FIG. 4A.2

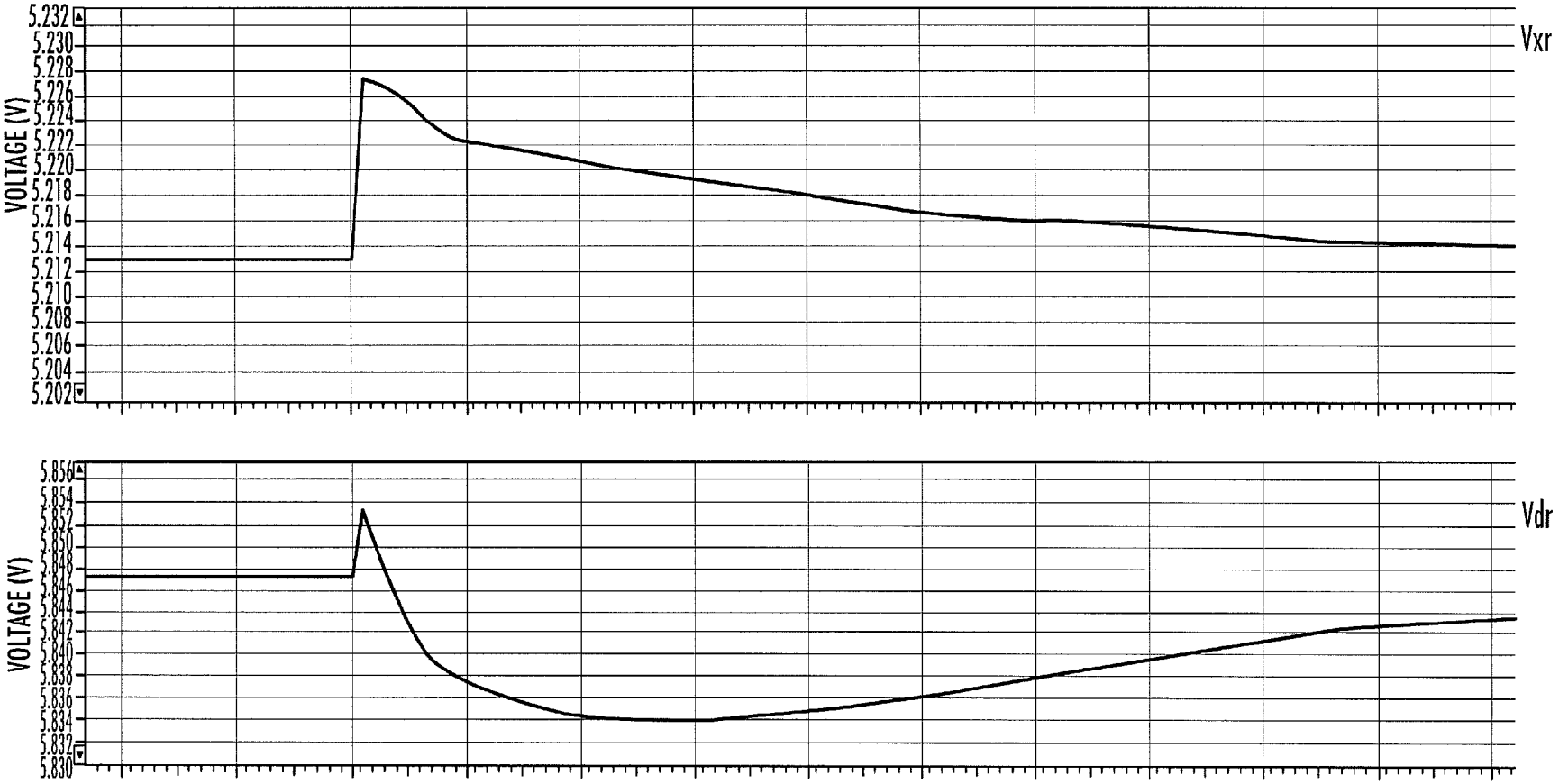
FIG. 4B.1

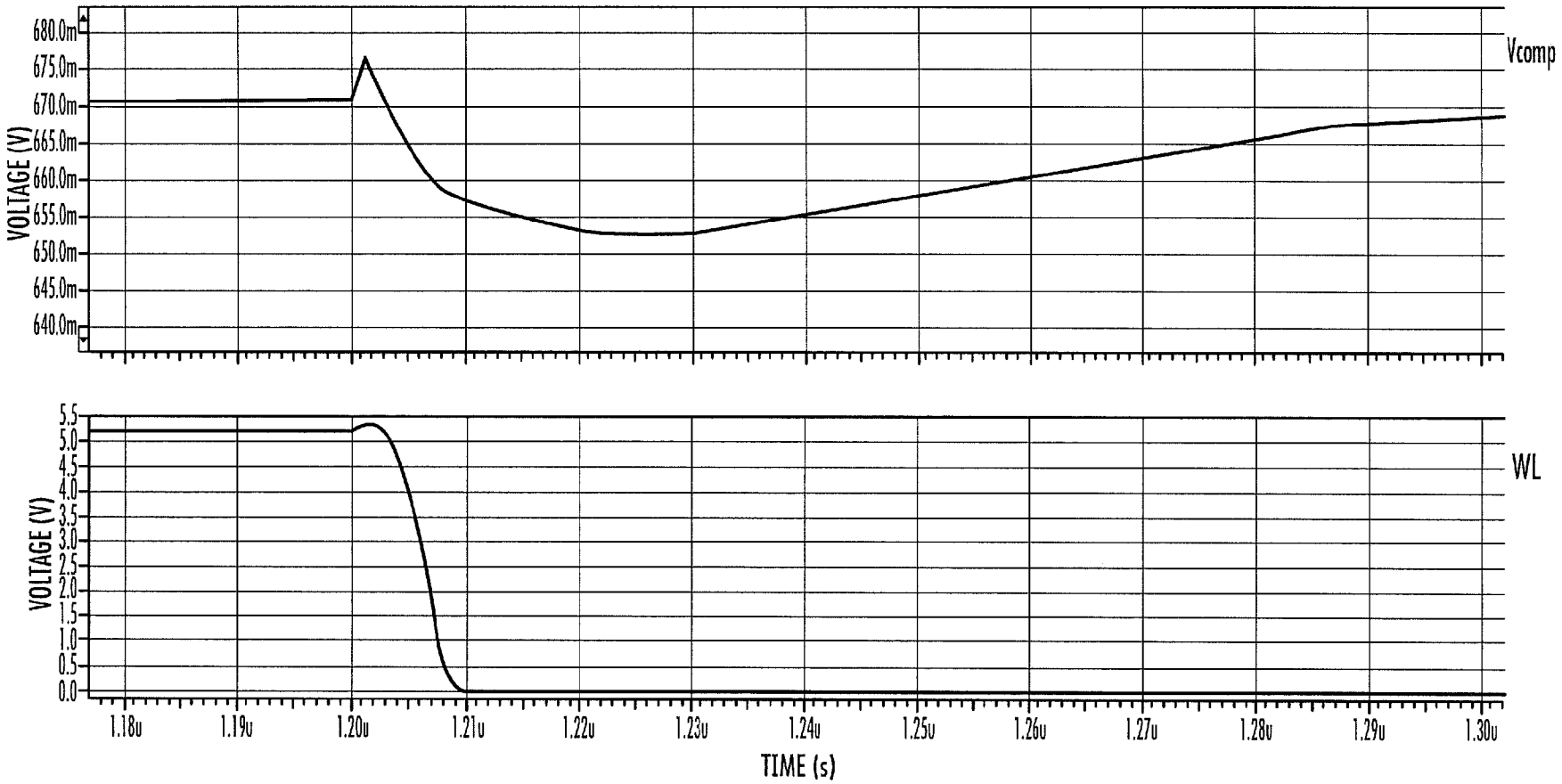
FIG. 4B.2

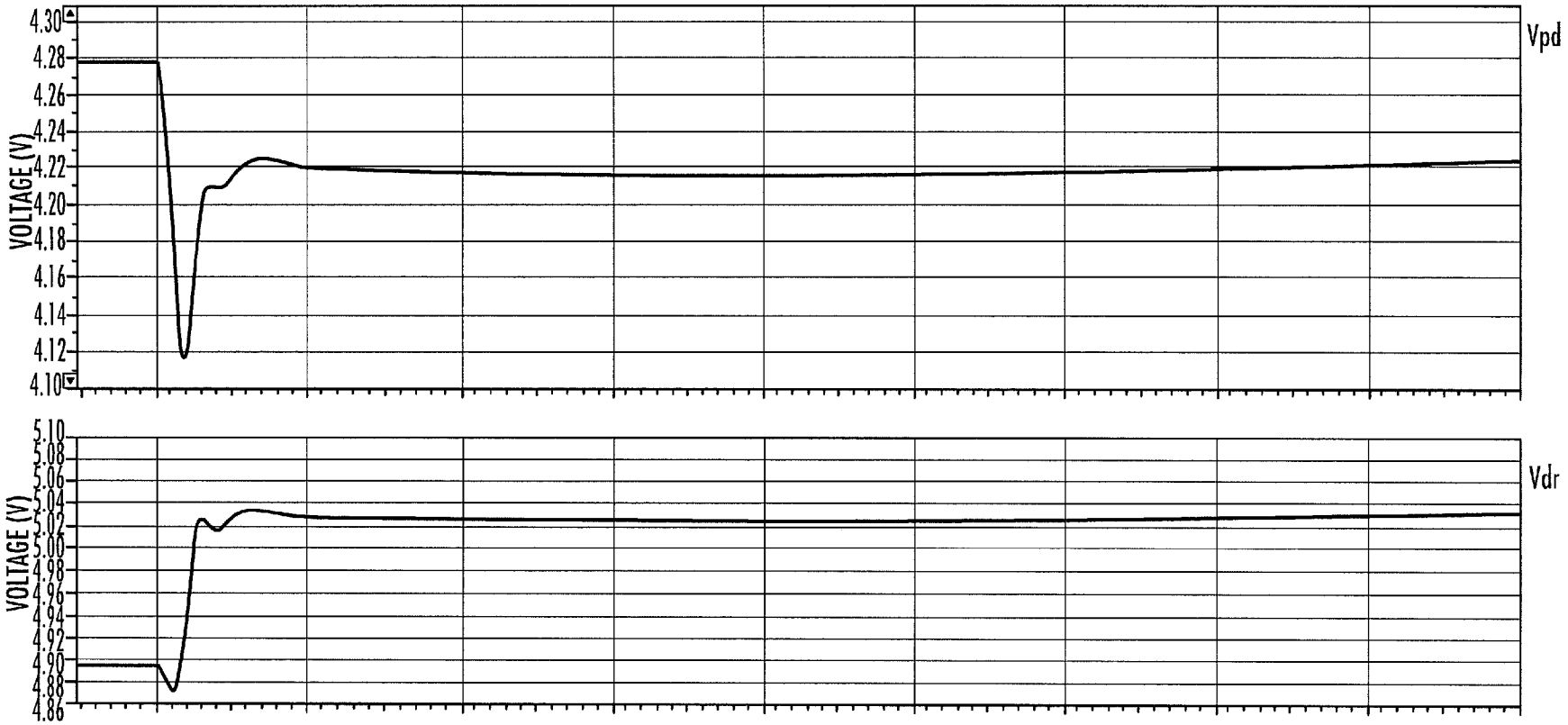
FIG. 5A.1

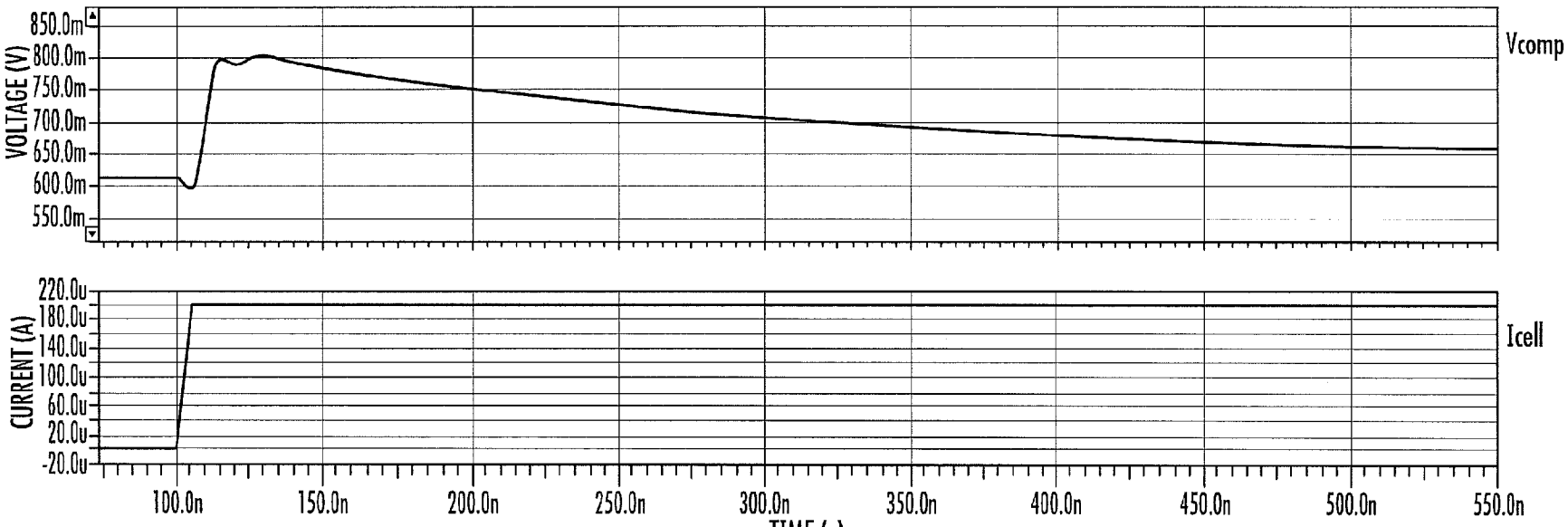
FIG. 5A.2

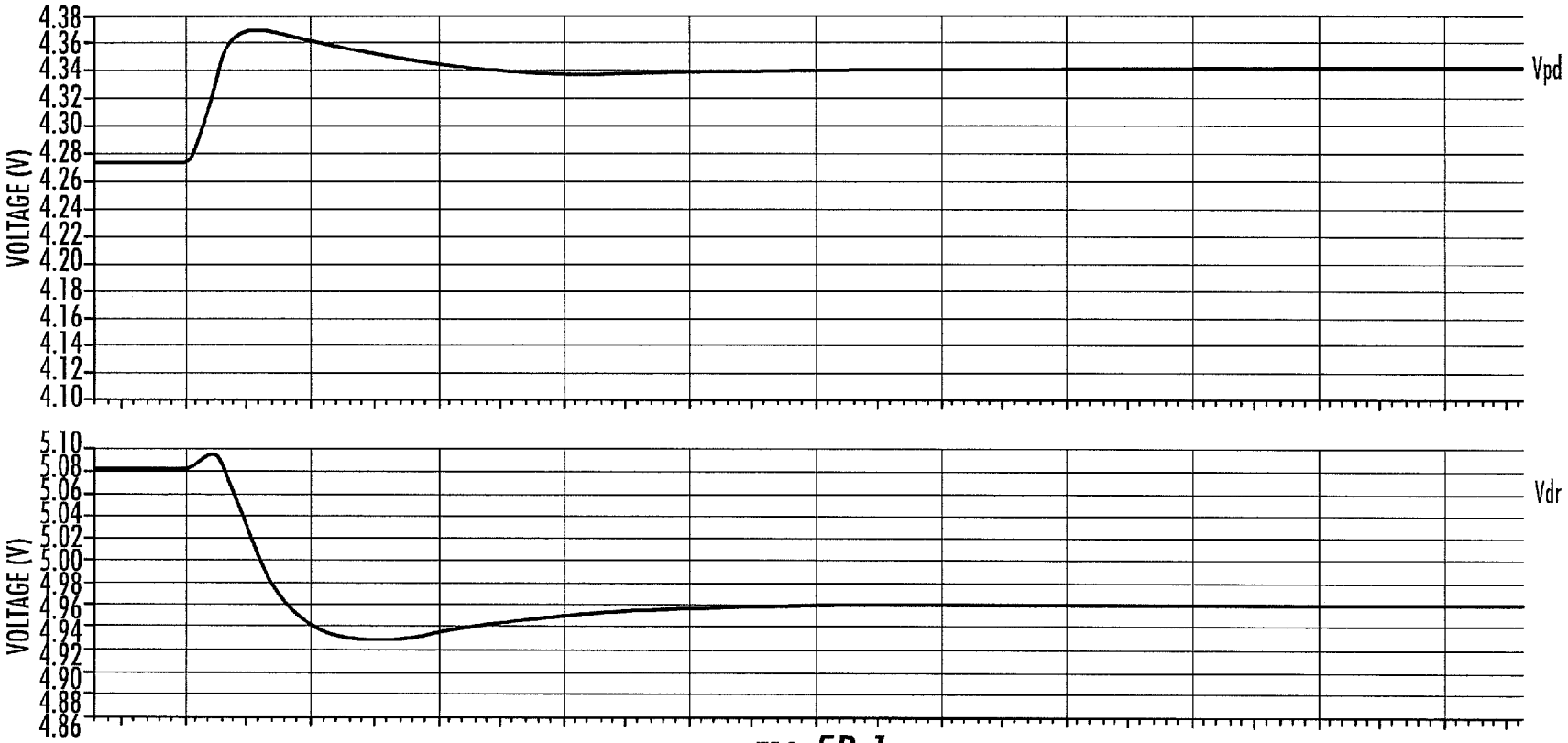
FIG. 5B.1

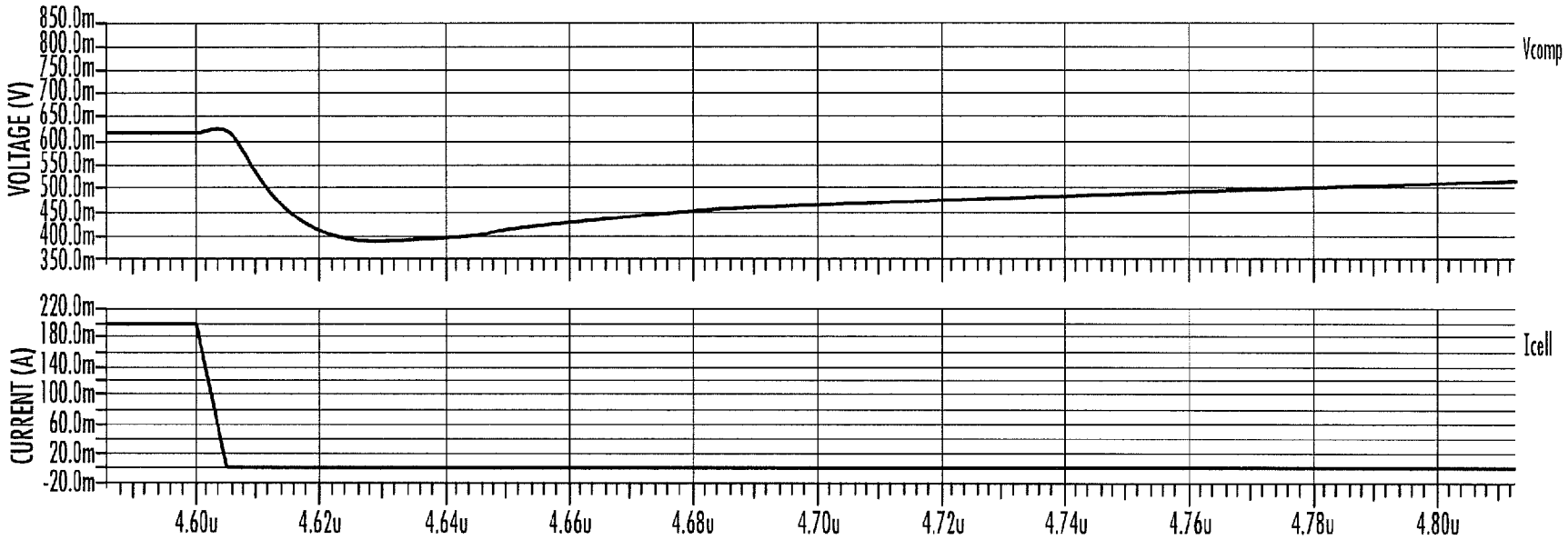
FIG. 5B.2

VOLTAGE REGULATOR

FIELD OF THE INVENTION

The present disclosure relates to a voltage regulator, more specifically, a voltage regulator for the generation of writing and reading voltages for a non-volatile memory device.

BACKGROUND OF THE INVENTION

Non-volatile memories are widely used in applications where the data stored in the memory device is preserved even in the absence of an electrical supply. Among the types of non-volatile memories, the electrically programmable (and erasable) memories, such as the flash memories, are popular in the applications where the data to be stored is updated with frequency.

In order to be programmed, the cells of a flash type memory may require the application of respective programming pulses at the drain terminals. To be read, the cells instead require that the gate terminals be biased to a respective reading voltage. The voltage value of the programming pulses is typically different from the value of the reading voltage. For example, the programming pulses may be on the order of 4 volts, while the reading voltage may be on the order of 5 volts.

These voltages are typically generated by taking the output voltage of a voltage boost circuit, such as a charge pump, and regulating the value thereof by way of a voltage regulator circuit coupled to the output of the charge pump. Among the various types of voltage regulators, the type more readily employed in this application is the so-called "linear" topology, i.e. based upon a regulation transistor adapted to operate in the linear region for regulating the output voltage to the desired voltage to make the output of the voltage regulator as stable as possible. The regulation transistor is typically driven by a feedback-connected operational amplifier.

In order to optimize the area consumption within the semiconductor material die where the flash memory is integrated, a single voltage regulator is used for generating the required voltages both during the reading operations and the writing operations. The design of a voltage regulator of this type may be problematic, since such a regulator should be capable of rapidly and efficiently compensating for the sudden voltage variations due to abrupt changes of load and current demands during selection of the memory cells for the reading and programming operations.

Specifically, during a programming operation, a group of selected memory cells is biased for receiving a respective programming current, for example, of the order of 60 uA per cell. As soon as the memory cells of the group to be programmed are selected, the current request tends to rapidly decrease the voltage of the output terminal of the voltage regulator. This voltage decrease is compensated by the voltage regulator, which acts by increasing the driving voltage of the regulation voltage. As soon as the memory cells of the group are deselected (when the programming is ended), the current request suddenly expires, and the voltage of the output terminal of the voltage regulator tends to rapidly increase. In this case, the compensation carried out by the voltage regulator provides for reducing the driving voltage of the regulation transistor.

During a reading operation, a group of memory cells is selected for reading of stored data, such selection provides for a rapid increase of the load (for example, of the order of about 500 fF) caused by the coupling with the gate terminals of the memory cells of the group. This increase of the load generates a corresponding increase in the current request, which tends to rapidly lower the voltage in the output terminal of the voltage regulator. In this case as well, the voltage decrease is compensated by the voltage regulator, which operates by increasing the driving voltage of the regulation transistor. As soon as the memory cells of the group are deselected (when the reading is ended), the current request suddenly expires, since the load suddenly decreases, and the voltage of the output terminal of the voltage regulator tends to increase. As a consequence, the compensation carried out by the voltage regulator provides for decreasing the driving voltage of the regulation transistor.

In order to improve the performance of the voltage regulator, both from the response speed point of view and from the stability point of view, different approaches have been disclosed. Particularly, an approach provides for increasing the response speed of the regulator by increasing the response speed of the operational amplifier. However, this approach may be problematic from the electric power consumption point of view, especially in the case wherein the operational amplifier is directly supplied by the charge pump coupled to the regulator itself.

According to another approach, the stability of the voltage regulator is improved by increasing the capacity of the output terminal (of the voltage regulator), for example, through the connection of one or more additional filter capacitors. However, the addition of capacitors may require an excessive waste of area in the semiconductor material die where the flash memory is integrated.

U.S. Pat. No. 5,945,819 discloses a voltage regulator coupled between first and second voltage references and having an output terminal for delivering a regulated output voltage. The voltage regulator includes at least one voltage divider, coupled between the output terminal and the second voltage reference, and a serial output element coupled between the output terminal and the first voltage reference. The voltage divider is coupled to the serial output element by a first conduction path, which includes at least one error amplifier whose output is coupled to at least one driver for turning off the serial output element. The voltage regulator includes, between the voltage divider and the serial output element, at least a second conduction path for turning off the serial output element according to a value of the regulated output voltage in advance of the action of the first conduction path. U.S. Pat. No. 7,714,553 discloses a voltage regulator that includes an under voltage detector having a charge transistor smaller than an output transistor of the voltage regulator, providing a detection path for fast response, and compensating for the under voltage without large control current when loading changes from light to heavy.

U.S. Patent Application Publication No. 2003/098674 discloses a wideband voltage regulator which is configured to provide suppression of fast transients and includes a boosting circuit and a sensing circuit. The boosting circuit can be suitably configured to boost the voltage regulator response, while the sensing circuit can determine when such a boost may be desired. Accordingly, the response of the voltage regulator can be accelerated to a fast load transient beyond the closed loop bandwidth limited response or the slew rate limited response of the voltage regulator. An exemplary voltage regulator can be configured with an active sensing circuit comprising a sensing amplifier with switch control outputs, and a boosting circuit comprising N stored charge sources, e.g. boost capacitors, and (3N−1) switches that are configured to accelerate the voltage regulators response to a fast load transient beyond the closed loop bandwidth limited or slew rate limited response of the voltage regulator.

U.S. Pat. No. 6,157,176 discloses a linear type of voltage regulator having at least one input terminal adapted to receive a supply voltage and one output terminal adapted to deliver a regulated output voltage, a power transistor, and a driver circuit for the transistor. The driver circuit includes an operational amplifier having an input differential stage biased by a bias current, which varies proportionally with the variations of the regulated output voltage at the output terminal of the regulator.

The approaches disclosed in U.S. Pat. Nos. 5,945,819 and 7,714,553 and in U.S. Patent Application Publication No. 2003/098674 are capable of increasing the speed of the voltage regulator only in response to load increases. Employing approaches of this type when the load diminishes (e.g. at the end of a reading operation) may result in the response of the voltage regulator being excessively slow. The approach disclosed in U.S. Pat. No. 6,157,176 may entail a drastic increase in power consumption, in terms of current required by the charge pump.

SUMMARY OF THE INVENTION

According to an embodiment of the present disclosure, a voltage regulator may comprise an input terminal for receiving an input voltage and at least one output terminal for providing at least one respective output voltage. The regulator may further comprise a regulation transistor having a first conduction terminal coupled to the input terminal for receiving the input voltage, a second conduction terminal coupled to the at least one output terminal, and a control terminal coupled to the output of a first operational amplifier. The first operational amplifier may have a non-inverting input terminal for receiving a first reference voltage, and an inverting input terminal coupled to a first terminal of a divider circuit for receiving a second reference voltage. The divider circuit may further comprise a second terminal coupled to the second conduction terminal of the regulation transistor for providing a regulation voltage to the second conduction terminal of the regulation transistor when crossed by a current generated by the regulation transistor. The value of the at least one output voltage may depend on the value of the regulation voltage. The regulator may further comprise a compensation circuit coupled to the control terminal of the regulation transistor for providing a compensation voltage in response to variations of the regulation voltage caused by variations of the load and current requests by the load.

BRIEF DESCRIPTION OF THE DRAWINGS

These and other features and advantages of the present disclosure will be better understood with reference to the following description of some exemplificative and non limitative embodiments, to be read in conjunction with the attached drawings, wherein:

FIGS. 4A and 4B illustrate time trends of some voltages and currents of the regulator of FIG. 3 during a reading operation; and FIGS. 5A and 5B illustrate a time trend of some voltages and currents of the regulator of FIG. 3 during a programming operation.

DETAILED DESCRIPTION OF THE PREFERRED EMBODIMENTS

Figure 1:
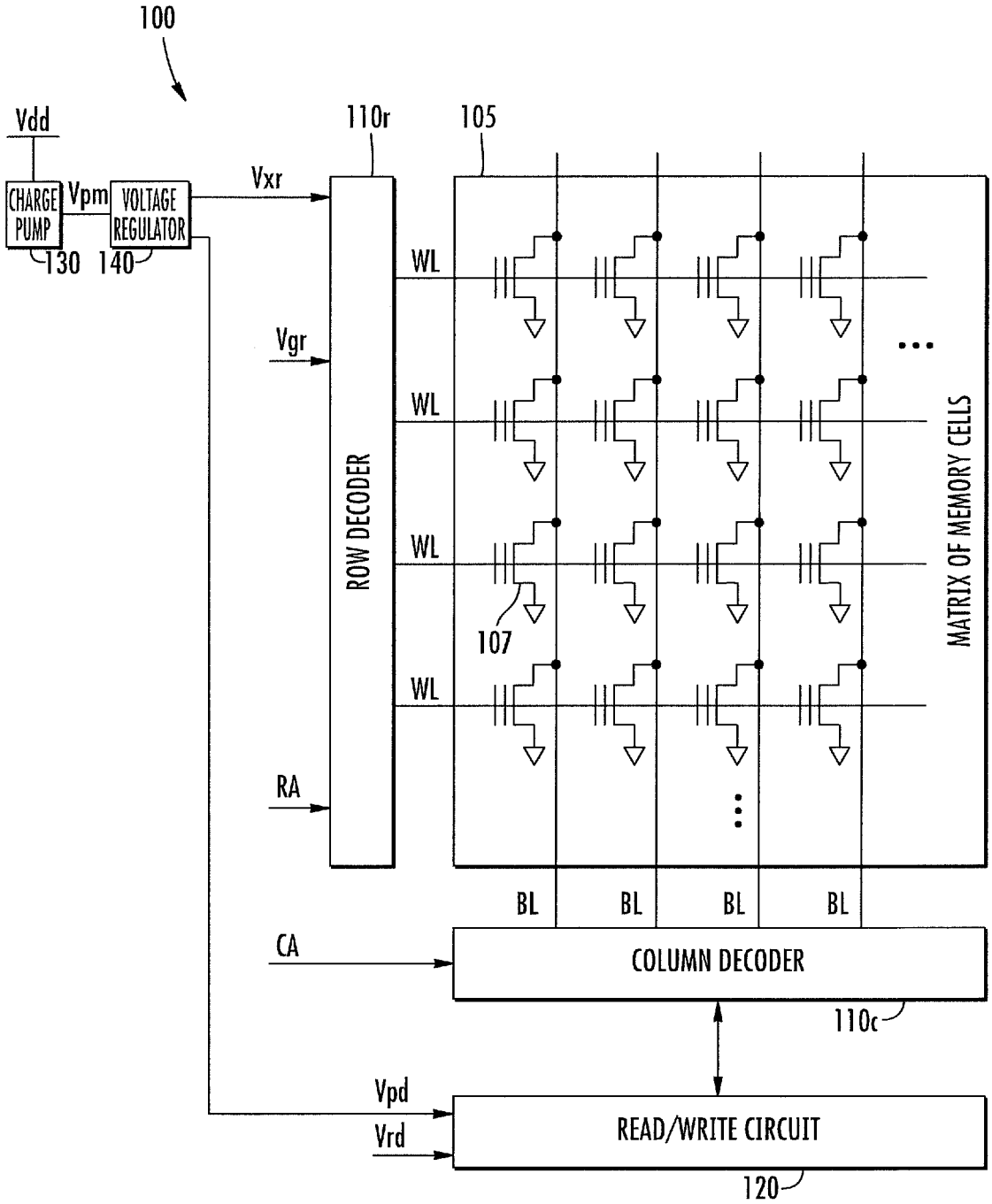
FIG. 1 PRIOR ART
FIG. 1 is a schematic diagram of a memory device, according to the prior art.

With reference in particular to FIG. 1, a portion of a memory device 100 particularly of the flash type, is illustrated. The flash memory 100 is integrated in a semiconductor material die, and a matrix 105 of memory cells 107 (particularly, a matrix with a NOR type architecture, as shown in FIG. 1) is used to store data. Each memory cell 107 comprises a floating gate MOS transistor. The memory cell 107, in an unprogrammed (or erased) condition and exhibits a relatively low threshold voltage. The memory cell 107 is programmed by injecting electric charge into its floating gate. In this condition, the memory cell 107 exhibits a relatively high threshold voltage. The value of the threshold voltage thus defines the different logic values that the data included in the memory cells 107 may assume. The memory cell 107 is erased by removing the electric charge stored in its floating gate.

The cells 107 are arranged in rows and columns. The matrix 105 includes a word line WL for each row and a bit line BL for each column. The memory cell 107, belonging to a generic row and to a generic column, has the gate terminal coupled to the word line WL associated to such row, the drain terminal coupled to the bit line BL associated to the column, and the source terminal coupled to a reference terminal for receiving the ground voltage. During a programming or reading operation, a group of memory cells 107 belonging to a same row are selected in parallel for being programmed/read.

The row selection is carried out by a row decoder 110*r*, which receives at its input a row address RA, decodes the address, and selects a corresponding row of the matrix. Particularly, during a reading operation, the row decoder 110*r* biases the word line WL corresponding to the selected memory cells 107 to a row selection voltage Vxr (for example, equal to about 5.2 volts), while the other word lines WL are biased to a deselection voltage, such as the ground voltage. During a writing operation, the row decoder 110*r* provides to the corresponding word line WL a programming voltage ramp Vgr (for example, starting from a value equal to 3 volts to a value of 9 volts), while the other word lines WL are biased to the deselection voltage.

The column selection is carried out by a column decoder 110*c*, which receives at its input a column address CA, decodes the address, and selects a corresponding group of matrix rows. Particularly, the column decoder 110*c* connects the bit lines BL corresponding to the selected memory cells 107 to a read/write circuit 120, while the remaining bit lines BL are kept floating. During a reading operation, the read/write circuit 120 biases the bit lines BL selected by the column decoder 110*c* to a reading voltage Vrd (for example, equal to 0.65 volts). During a programming operation, the read/write circuit 120 provides a program pulse, having a voltage value Vpd (for example, equal to about 4.2 volts), to the bit lines BL selected by the column decoder 110*c*.

The memory device 100 includes a charge pump 130 configured to receive the supply voltage Vdd of the flash memory 100 (for example, having a value equal to 1.2 volts) and increase its value by outputting a corresponding pump voltage Vpm (for example, having a value equal to 6.5 volts). The output of the charge pump 130 is coupled to a voltage regulator 140, which is configured to generate, starting from the pump voltage Vpm, the voltages Vxr and Vpd.

Figure 2:
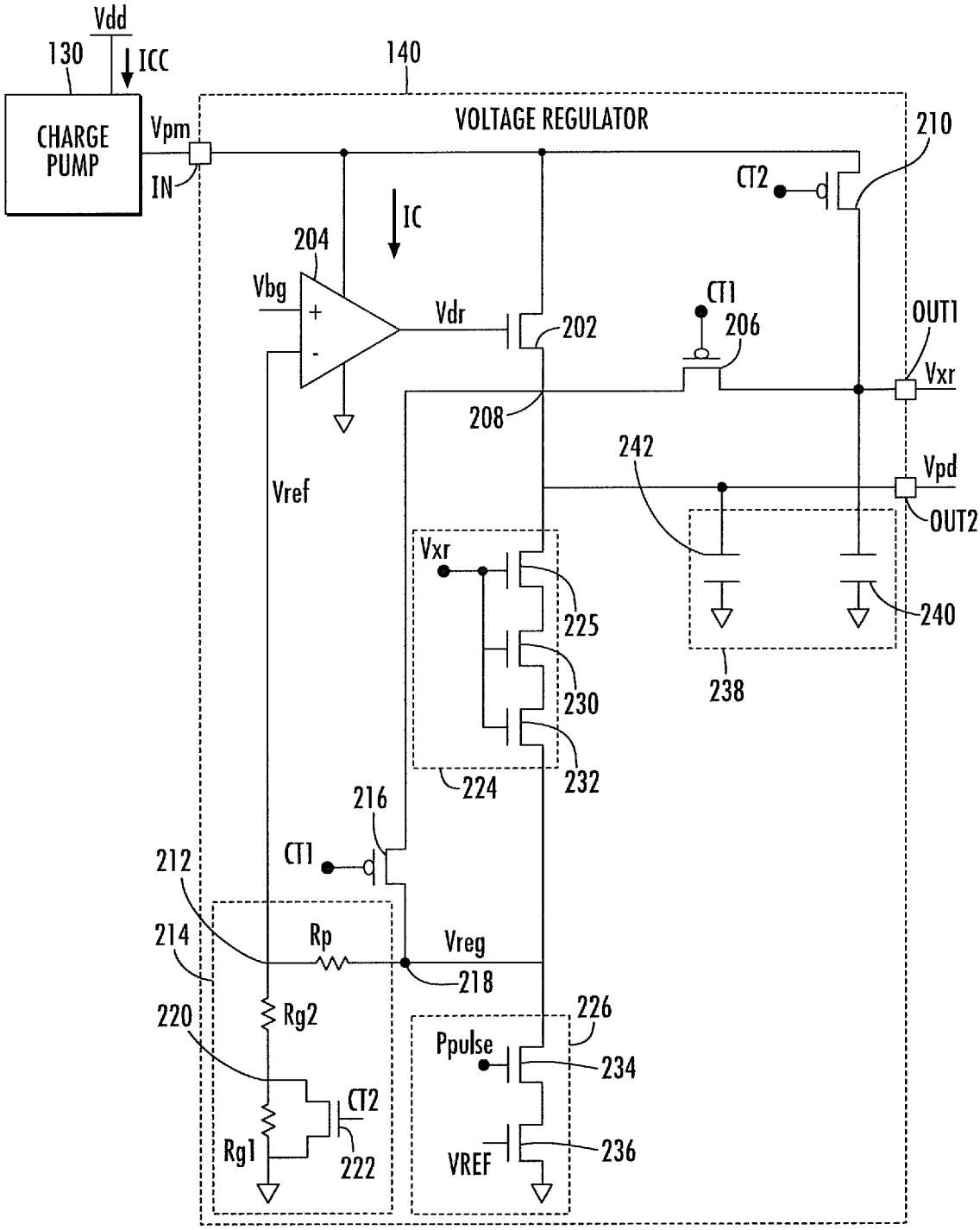
FIG. 2 PRIOR ART
FIG. 2 is a circuit diagram of a voltage regulator of the memory device of FIG. 1, according to the prior art.

FIG. 2 illustrates in detail a possible circuit diagram of the voltage regulator 140 according to a known approach. The voltage regulator 140 is of the linear type, since the voltages Vxr and Vpd are regulated by a regulation transistor 202, specifically an n-channel MOS transistor. The regulation transistor 202 is driven by an operational amplifier 204 inserted in a (negative) feedback loop.

Specifically, the voltage regulator 140 has an input terminal IN coupled to the output of the charge pump 130 for receiving the pump voltage Vpm. The regulation transistor 202 has a drain terminal coupled to the input terminal IN, a gate terminal coupled to an output terminal of the operational amplifier 204 for receiving a control voltage N1, and a source terminal coupled to a first conduction terminal of a p-channel MOS transistor 206 (circuit node 208). The transistor 206 has a gate terminal adapted to receive a first control signal CT1, and a second conduction terminal coupled to a first output terminal OUT1 of the voltage regulator adapted to provide the voltage Vxr to the row decoder of the memory during a reading operation. The control signal CT1 is a signal of the digital type, adapted to assume a first voltage value equal to the pump voltage Vpm and a second voltage value equal to the ground voltage. A p-channel MOS transistor 210 has a source terminal coupled to the drain terminal of the regulation transistor 202, a drain terminal coupled to the first output terminal OUT1, and a gate terminal adapted to receive a second control signal CT2. The second control signal CT2 is a signal of the digital type, and particularly it is the negated of the first control signal CT1. The voltage regulator 140 further comprises a second output terminal OUT2 coupled to the node 208. The second output terminal OUT2 is adapted to provide the voltage Vpd to the read/write circuit of the memory during a programming operation.

The operational amplifier 204 has an inverting input terminal that receives a voltage Vbg, for example, generated by a temperature-compensated reference device and based on the band gap voltage, and an inverting input terminal coupled to an intermediate node 212 of a resistive divider 214 for receiving a reference voltage Vref. The operational amplifier 204 is supplied by the pump voltage Vpm generated by the charge pump 130. The current Ic requested by the operational amplifier 204 for operating causes a current request from the charge pump 130 of N*Ic, wherein N is the inefficiency of the charge pump 130.

The resistive divider 214 comprises three resistors Rp, Rg1, and Rg2. The resistor Rp has a first terminal coupled to the node 212 and a second terminal coupled to a drain terminal of a p-channel MOS transistor 216 (circuit node 218). The resistor Rg2 has a first terminal coupled to the node 212 and a second terminal coupled to a first terminal of the resistor Rg1 (circuit node 220). The resistor Rg1 has a second terminal coupled to a reference terminal for receiving the ground voltage. An n-channel MOS transistor 222 is coupled in parallel to the resistor Rg1, specifically, the transistor 222 has a drain terminal coupled to the node 220, a source terminal coupled to the reference terminal, and a gate terminal that receives the second control signal CT2. The transistor 216 has a gate terminal that receives the first control signal CT1 and a source terminal coupled to the node 208. As will be described in the following, the voltage at the circuit node 218—referred to as "regulation voltage" and identified with Vreg—is used by the voltage regulator 140 for generating both the voltage Vxr and the voltage Vpd. The voltage regulator 140 further comprises a column decoder emulating circuit 224 and a cell current emulating circuit 226.

The circuit 224 comprises three n-channel MOS transistors 228, 230, 232 coupled in series between the node 208 and the node 218. Specifically, the transistor 228 has a drain terminal coupled to the node 208 and a source terminal coupled to a drain terminal of the transistor 230, while the transistor 232 has a drain terminal coupled to a source terminal of the transistor 230 and a source terminal coupled to the node 218. The gate terminals of the transistors 228, 230 and 232 are coupled to each other for receiving the voltage Vxr. The transistors 228, 230 and 232 are sized in such a way to have a resistance similar to that of the generic selection branch of the column decoder 110*c* when they are crossed by a current corresponding to the programming current of the generic memory cell.

The purpose of the circuit 226 is to generate the current flowing in the circuit 224. The circuit 226 comprises two n-channel MOS transistors 234, 236 coupled in series between the node 218 and a reference terminal biased to the ground voltage. Specifically, the transistor 234 has a drain terminal coupled to the node 218, a source terminal coupled to a drain terminal of the transistor 236, and a gate terminal that receives a driving signal Ppulse. The transistor 236 has a source terminal coupled to a reference terminal for receiving the ground voltage and a gate terminal that receives a bias voltage Viref. The sizing of the transistor 236 and the value of the bias voltage Viref are chosen in such a way that the current flowing into the transistor 236 has a value corresponding to the value of the programming current of the generic memory cell.

The voltage regulator 140 is provided with a filtering unit 238 comprising a first filtering capacitor 240 and a second filtering capacitor 242. Specifically, the filtering capacitor 240 has a first terminal coupled to the first output terminal OUT1 of the voltage regulator and a second terminal coupled to a reference terminal for receiving the ground voltage. The filtering capacitor 242 has a first terminal coupled to the second output terminal OUT2 of the voltage regulator and a second terminal coupled to the reference terminal for receiving the ground voltage.

The voltage regulator 140 may operate in two distinct modes, each one corresponding to a specific operation carried out by the flash memory. In a first mode, defined as a reading mode and enabled during a reading operation of the flash memory, the first output terminal OUT1 provides the voltage Vxr to the row decoder 110*r*, while in a second mode, defined as a programming mode and enabled during a programming operation of the flash memory, the second output terminal OUT2 provides the voltage Vpd to the read/write circuit 120. During the reading mode, the first control signal CT1 is equal to 0 (ground voltage), while the second control signal CT2 is equal to the pump voltage Vpm. On the contrary, during the writing mode, the first control signal CT1 is equal to the pump voltage Vpm, while the second control signal CT2 is equal to 0.

The operation of the voltage regulator 140 provides that the operational amplifier 204 drives the gate terminal of the regulation transistor 202 with a driving voltage Vdr such that the current flowing in the resistive divider 214 generates a reference voltage Vref (at the inverting terminal of the operational amplifier 204) equal to the voltage Vgb. The regulation voltage Vreg that develops at the node 218 because of the current flowing in the resistive divider 214 is used for generating the voltages Vxr and Vpd. The value assumed by the regulation voltage Vreg depends on the mode in which the voltage regulator is operating. Particularly: during the reading mode (CT1=0, CT2=Vpm), the transistor 222 is to be turned on, and Vreg=Vbg*(Rp+Rg2)/(Rg2), and during the programming mode (CT1=Vpm, CT2=0), the transistor 222 is to be turned off, and Vreg=Vbg*(Rp+Rg2+Rg1)/(Rg2+Rg1), wherein Rp, Rg1 and Rg2 are the resistances of the resistors Rp, Rg1 and Rg2, respectively.

Thus, by properly choosing the values of the resistances Rp, Rg1 and Rg2, it is possible to set the regulation voltage Vreg to a desired value. Making reference to the considered example, the resistances may be selected such that Vreg is approximately equal to 5.2 volts in the reading mode and to 4.2 volts in the programming mode.

In the reading mode, the transistor 216 is turned on. As a consequence, the node 208 is coupled to the node 218 through the transistor 216, excluding the column decoder emulating circuit 224. The voltage Vpd at the second output terminal OUT2 is to be equal to the regulation voltage Vreg, which in this case is equal to Vbg*(Rp+Rg2)/(Rg2), since the transistor 222 is to be turned on. In the reading mode the transistor 206 is turned on, too, short-circuiting the first output terminal OUT1 to the node 208. In this way, the voltage Vxr at the first output terminal OUT1 is to be equal to the voltage Vpd at the second output terminal OUT2, i.e. it will be equal to the regulation voltage Vreg. The voltage Vxr at the first output terminal OUT1 is provided to the row decoder 110*r*, which uses the voltage for biasing the selected wordline WL. In this mode, the read/write circuit 120 does not use the voltage Vpd at the second output terminal OUT2. It is noted that, during the reading mode, the driving signal Ppulse is kept at the ground voltage, keeping the transistor 234 turned off.

In the programming mode, the transistor 222 is to be turned off, and the regulation voltage Vreg is to be equal to Vbg*(Rp+Rg2+Rg1)/(Rg2+Rg1). In this mode, the transistor 216 is to be turned off. As a consequence, the node 208 is to be coupled to the node 218 through the column decoder emulating circuit 224. Unlike the reading mode, where the voltage Vpd was equal to the regulation voltage Vreg at the node 218, the voltage Vpd is now made to depend also on the current flowing in the column decoder emulating circuit 224. This current is generated by the cell current emulating circuit 226. Specifically, the driving signal Ppulse is brought to a voltage value such to turn on the transistor 234 for a period corresponding to the duration of the typical programming pulse, in such a way that a current pulse corresponding to the typical programming pulse flows into the circuit 224. A voltage drop Vde develops between the node 218 and the second output terminal OUT2 (node 208). The voltage drop is equal to the sum of the drain-source voltages of the transistors 228, 230 and 232. Due to the particular sizing of the transistors 228, 230 and 232, the voltage drop Vde that develops further to the passage of the current pulse efficiently reproduces (in absolute value) the voltage drop Vdc that develops in the selection path within the column decoder 110*c* during the programming. The absolute value of the voltage Vpd at the second output terminal OUT2 is to be equal to Vreg+Vde. The voltage Vpd is provided to the read/write circuit 120, which, through the column decoder 110*c* (which introduces a voltage droop Vdc), uses such voltage for biasing the selected bit lines BL. Specifically, the voltage Vbl that the bit lines actually assume is to be equal to Vpd−Vdc=Vreg+Vde−Vdc. Thanks to the particular sizing of the circuits 224 and 226, the two terms Vde and Vdc alter each other, and thus Vbl=Vreg, i.e. the bit lines BL are biased with the voltage value set by the resistive divider 214 of the regulator. During the programming mode, the transistor 206 is to be turned off, while the transistor 210 is to be turned on. In this way, the voltage Vrx at the first output terminal OUT1 is to be equal to the pump voltage Vpm. It is noted that in this mode, the voltage Vxr is not used by the row decoder 110*r* for biasing the word lines WL, but it may be advantageously exploited by the memory for other purposes.

As already mentioned, the previously described voltage regulator 140 is subjected to abrupt variations of load and current request caused by the selection and deselection of the memory cells during the reading and programming operations.

When the voltage regulator 140 is in the reading mode, and a group of memory cells is selected by the row decoder 110*r* for being read, the corresponding request of current tends to rapidly lower the voltage Vxr of the first output terminal OUT1. Through the transistors 206 and 216, the decreasing of the voltage Vxr affects the nodes 208, 218 and 212 as well, causing a consequent lowering of the regulation voltage Vreg and the reference voltage Vref. The voltage decrease is detected by the operational amplifier 204, which responds by increasing the driving voltage Vdr of the regulation transistor 202. In this way, the voltage at the node 208—i.e. the voltage Vxr—tends to increase for compensating the preceding decreasing. As soon as the memory cells are deselected by the row decoder 110*r*, the voltage Vxr is subjected to a temporary increasing, caused by capacitive couplings in the row decoder 110*r*. Through the transistors 206 and 216, the increase of the voltage Vxr affects nodes 208, 218 and 212 as well, causing a consequent increase of the regulation voltage Vreg and the reference voltage Vref. This increment is detected by the operational amplifier 204, which responds by reducing the driving voltage Vdr of the regulation transistor 202. In this way, the voltage at the node 208—i.e. the voltage Vxr—tends to decrease for compensating the preceding increasing.

When the voltage regulator 140 is in the programming mode, and a group of memory cells is selected by the column decoder 110*c* for receiving the programming pulses generated by the read/write circuit 120, the corresponding request of current tends to rapidly lower the voltage Vpd of the second output terminal OUT2. Through the circuit 224, the lowering of the voltage Vpd affects the nodes 218 and 212 as well, causing a consequent decrease of the regulation voltage Vreg and the reference voltage Vref. The voltage decrease is detected by the operational amplifier 204, which responds by increasing the driving voltage Vdr of the regulation transistor 202. In this way, the voltage at node 208—i.e. the voltage Vpd—tends to increase for compensating the preceding decreasing. As soon as the programming pulses have ended, the request of current suddenly stops, and the voltage Vpd of the second output terminal OUT2 tends to rapidly decrease. Through the circuit 224, the increasing of the voltage Vpd affects the nodes 218 and 212 as well, causing a consequent increase of the regulation voltage Vreg and of the reference voltage Vref. The increment is detected by the operational amplifier 204, which responds to decreasing the driving voltage Vdr of the regulation transistor 202. In this way, the voltage at node 208—i.e. the voltage Vpd—tends to decrease for compensating the preceding increasing.

Because of the rapidity of the variations of load and current request, the voltage regulator 140 may not be able to respond in a sufficiently fast way. As a consequence, during a large extent of the reading and programming operations of the memory, the values of the voltages Vxr and Vpd provided to the row decoder and to the read/write circuit are not correct, being too high or too low. This may strongly lower the performance of the memory, until compromising the correct outcome of the reading and writing operations.

In order to limit the variations of the voltages Vxr and Vpd caused by the variations of load and current request, a known approach provides for using filtering capacitors 240, 242 coupled to the output terminals OUT1 and OUT2 having a sufficiently high capacity. Furthermore, by increasing the capacity of such capacitors, the stability of the voltage regulator 140 would be also increased. However, the increase of capacity for the capacitors causes an excessive growth of the area occupied in the semiconductor chip where the memory is integrated.

According to another known approach, the response speed of the voltage regulator 140 is increased by increasing the response speed of the operational amplifier 204, i.e. by increasing the value of the current Ic. However, increasing the response speed of the operational amplifier 204 may be problematic from the electric power consumption point of view, since an increase of the current Ic requested by the operational amplifier 204 causes a current request from the charge pump 130 equal to N*Ic.

In general terms, according to an embodiment of the present disclosure, the performance of a voltage regulator of the type illustrated in FIG. 2 may be drastically improved by way an additional compensation circuit adapted to provide additional voltage pulses at the gate terminal of the regulation transistor such to counter balance the increasing or decreasing of the regulation voltage Vreg.

Figure 3:
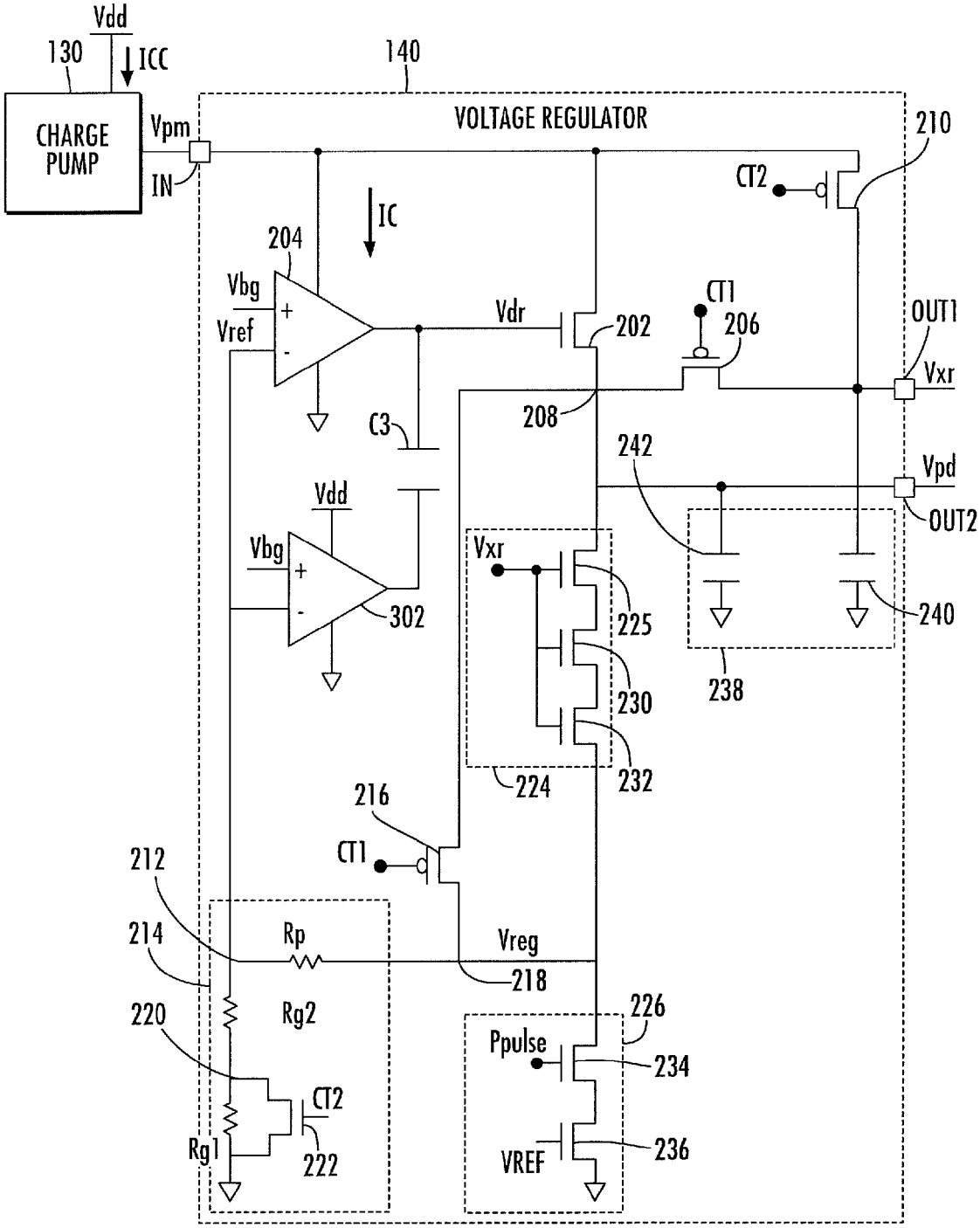
FIG. 3 is a circuit diagram of a voltage regulator of a memory device, according to an embodiment of the present disclosure.

Specifically, FIG. 3 illustrates in detail a possible implementation of a voltage regulator 140' according to an embodiment of the present disclosure. The components of the voltage regulator 140' of FIG. 3 that correspond to components of the voltage regulator 140 of FIG. 2 will not be described again, for the sake of simplicity.

According to an embodiment of the present disclosure, the additional compensation circuit comprises an additional operational amplifier 302 having a non-inverting input terminal coupled to the non-inverting input terminal of the operational amplifier 204 for receiving the voltage Vbg, an inverting input terminal coupled to the intermediate node 212 of the resistive divider 214 for receiving the reference voltage Vref, and an output terminal coupled to the output terminal of the operational amplifier 204 by a capacitor C3 for providing a compensation voltage Vcomp.

According to an embodiment of the present disclosure, the operational amplifier 302 is formed by "low-voltage" devices, and it is directly supplied by the memory supply voltage Vdd. The operational amplifier 302 is designed to have a low gain, for example, of the order of 5, in such a way to avoid putting the output in saturation when the amplifier is in an open loop connection (because of the presence of the capacitor C3 coupled to the output terminal). In order to guarantee a high output dynamic range, the common-mode bias of the operational amplifier 302 is to correspond to a compensation voltage Vcomp equal to Vdd/2. The purpose of the operational amplifier 302 is to provide, through the capacitor C3, a voltage pulse at the gate terminal of the regulation transistor 202 such to counterbalance the increasing or decreasing of the voltage regulation Vreg further to the load and current request variations during the reading and programming operations.

In order to describe the operation of the voltage regulator 140' according to an embodiment of the present disclosure during a reading operation, reference will be now made to FIG. 2 together with FIG. 4A and FIG. 4B. FIG. 4A illustrates an exemplificative time trend of the voltage Vxr generated by the regulator 140', of the driving voltage Vdr generated by the operational amplifier 204, of the compensation voltage Vcomp generated by the operational amplifier 302 and of the voltage Vwl of the word line selected during the initial phase of the reading operation, i.e. during the selection of the word line WL, while FIG. 4B illustrates an exemplificative trend of such voltages during the final phase of the reading operation, i.e. during the deselection of the word line WL previously selected.

Specifically, as soon as the word line WL is selected by the row decoder for being biased with the voltage Vxr generated by the regulator 140', the load increase seen from the first output terminal OUT1 of the regulator 140' (in the considered example, equal to about 500 fF) causes a decrease of the voltage Vxr itself. This decrease causes a decreasing of the regulation voltage Vreg, and thus of the reference voltage Vref provided to the inverting terminals of the operational amplifiers 204 and 302. As already described above, the operational amplifier 204 reacts by trying to increase the driving voltage Vdr of the regulation transistor 202. The decreasing of the reference voltage Vref is also detected by the operational amplifier 302, which responds by increasing the compensation voltage Vcomp. The increasing of the compensation voltage Vcomp overlaps with the driving voltage Vdr through the capacitor C3. In this way, the increasing of the driving voltage Vdr of the regulation transistor 202 is to be more rapid, thereby speeding up the injection of current into the load.

At the deselection of the word line WL, the load is abruptly reduced, causing an increasing of the voltage Vxr. This change causes an increase of the regulation voltage Vreg, and thus of the reference voltage Vref provided to the inverting terminals of the operational amplifiers 204 and 302. The reference voltage Vref exceeds the level of the voltage Vbg at the non-inverting terminals of the amplifiers 204 and 203. In this case, the operational amplifier 302 responds by decreasing the compensation voltage Vcomp, transferring a negative voltage pulse at the gate terminal of the regulation voltage 202, in such a way to reduce the current generated by the transistor and bring the voltage Vref to the value of the voltage Vbg in a more rapid way.

In order to describe the operation of the voltage regulator 140' according to an embodiment of the present disclosure during a programming operation, reference will be now made to FIG. 2 together with FIG. 5A and FIG. 5B. FIG. 5A illustrates an exemplary time trend of the voltages Vpd, Vdr, Vcomp and of the programming current Icell flowing in the selected memory cells during the initial phase of the programming operation, i.e. further to the supply of the programming current pulse Icell to the selected memory cells. FIG. 5B illustrates an exemplificative trend of such voltages and of the current during the final phase of the programming operation, i.e. at the end of the programming current pulse Icell.

Specifically, as soon as the memory cells to be programmed are selected by the column decoder 110*c* for biasing the drain terminals with the voltage Vpd generated by the regulator 140', the programming current Icell requested by the cells to be programmed (in the considered example, equal to about 200 uA) at the second output terminal of the regulator 140' causes a decreasing of the voltage Vpd itself. As in the reading case, the change causes a decrease of the regulation voltage Vreg, and thus of the reference voltage Vref provided to the inverting terminals of the operational amplifiers 204 and 302. The decrease of the reference voltage Vref is detected by the operational amplifier 302, which responds by increasing the compensation voltage Vcomp. The increase of the compensation voltage Vcomp overlaps with the driving voltage Vdr through the capacitor C3, speeding up the increase of the driving voltage Vdr of the regulation transistor 202, and, as a consequence, the injection of current into the load.

At the end of the programming pulse, when the current Icell returns to zero, the voltage Vpd is subjected to an abrupt increase, which causes an increase of the regulation voltage Vreg, and thus of the reference voltage Vref provided to the inverting terminals of the operational amplifiers 204 and 302. In this case as well, the operational amplifier 302 responds by decreasing the compensation voltage Vcomp, transferring a negative voltage pulse to the gate terminal of the regulation transistor 202, in such a way to reduce the current generated by such transistor, and bring the voltage Vref to the value of the voltage Vbg in a more rapid way.

Due to the additional compensation provided by the operational amplifier 302 coupled in a negative feedback loop, the response speed and the stability of the regulator 140' are increased without having to excessively increase the whole manufacturing costs of the flash memory comprising the regulator itself, both in terms of current requested for the operation and in terms of area occupied within the semiconductor material die where the flash memory is integrated. Indeed, the request of additional current required to operate the operational amplifier 302 is reduced, since such amplifier is implemented by way of "low voltage" transistors and is directly supplied by the supply voltage Vdd, and not by the pump voltage Vpm generated by the charge pump 130. Moreover, thanks to the compensation action of the operational amplifier 302, it is possible to reduce the capacitance of the filtering capacitors 240, 242, thereby reducing the area occupation of the die for the implementation. Furthermore, since the operational amplifier 302 has a low gain, it is not necessary to implement any biasing compensation control for keeping the output at Vdd/2 in presence of process variations and mismatch effects of the devices.

Naturally, in order to satisfy local and specific requirements, a person skilled in the art may apply to the approach described above many modifications and alterations. For example, although in the description, reference has been made to a voltage regulator for a flash memory of the NOT type, the concepts of the present disclosure may be applied to memories of different type, such as, for example, flash memories of the NAND type.

Moreover, although reference has been made to a voltage regulator provided with two output terminals, each one adapted to provide a corresponding regulated voltage that depends on the regulation voltage, the concepts of the present disclosure may also apply to regulators with a different number of outputs (even a single output), since the compensation carried out by the additional compensation circuit is carried out based on the regulation voltage variations.

That which is claimed:

1. A voltage regulator comprising:

an input terminal configured to receive an input voltage;

at least one output terminal configured to provide at least one output voltage;

a first amplifier;

a regulation transistor having a first conduction terminal coupled to said input terminal, a second conduction terminal coupled to said at least one output terminal, and a control terminal coupled to an output of said first amplifier;

a voltage divider circuit comprising first and second terminals;

said first amplifier comprising a first input terminal configured to receive a first reference voltage, and a second input terminal coupled to said first terminal of said voltage divider circuit and configured to receive a second reference voltage;

said second terminal of said voltage divider circuit coupled to said second conduction terminal of said regulation transistor and configured to provide a regulation voltage thereto in cooperation with a current generated by said regulation transistor, the at least one output voltage being based upon the regulation voltage; and a compensation circuit coupled to said control terminal of said regulation transistor and configured to provide a compensation voltage in response to variations of the regulation voltage.

2. The voltage regulator of claim 1 wherein said compensation circuit is configured to:

decrease the compensation voltage in response to an increase of the regulation voltage; and increase the compensation voltage in response to a decrease of the regulation voltage.

3. The voltage regulator of claim 2 wherein said compensation circuit comprises a second amplifier having a first input terminal configured to receive the first reference voltage, a second input terminal coupled to said first terminal of said voltage divider circuit and configured to receive the second reference voltage, and an output terminal coupled to said control terminal of said regulation transistor and configured to provide the compensation voltage.

4. The voltage regulator of claim 3, wherein said compensation circuit further comprises a capacitor having a first terminal coupled to said output terminal of said second amplifier, and a second terminal coupled to said control terminal of said regulation transistor.

5. The voltage regulator of claim 3 wherein the input voltage is greater than the at least one output voltage; wherein said first amplifier is configured to be supplied by the input voltage; and wherein said second amplifier is configured to be supplied by a supply voltage lower than the input voltage.

6. The voltage regulator of claim 3 wherein said second amplifier has a selected gain for reducing saturation when connected in an open loop.

7. The voltage regulator of claim 5 wherein a common mode biasing voltage of said second amplifier is substantially equal to half a value of the supply voltage.

8. The voltage regulator of claim 1 wherein said voltage divider circuit is configured to have a variable resistance so that the at least one output voltage is based upon the variable resistance of said voltage divider circuit.

9. A voltage regulator comprising:

a first amplifier;

a regulation transistor having a first conduction terminal coupled to said first amplifier, a second conduction terminal, and a control terminal coupled to an output of said first amplifier;

a voltage divider circuit comprising first and second terminals;

said second terminal of said voltage divider circuit coupled to said second conduction terminal of said regulation transistor and configured to provide a regulation voltage thereto in cooperation with a current generated by said regulation transistor; and a compensation circuit coupled to said control terminal of said regulation transistor and configured to provide a compensation voltage in response to variations of the regulation voltage.

10. The voltage regulator of claim 9 wherein said compensation circuit is configured to:

decrease the compensation voltage in response to an increase of the regulation voltage; and increase the compensation voltage in response to a decrease of the regulation voltage.

11. The voltage regulator of claim 10 wherein said compensation circuit comprises a second amplifier having a first input terminal configured to receive a first reference voltage, a second input terminal coupled to said first terminal of said voltage divider circuit and configured to receive a second reference voltage, and an output terminal coupled to said control terminal of said regulation transistor and configured to provide the compensation voltage.

12. The voltage regulator of claim 11 wherein said compensation circuit further comprises a capacitor having a first terminal coupled to said output terminal output of said second amplifier, and a second terminal coupled to said control terminal of said regulation transistor.

13. The voltage regulator of claim 11 wherein said second amplifier has a selected gain for reducing saturation when connected in an open loop.

14. The voltage regulator of claim 11 wherein a common mode biasing voltage of said second amplifier is substantially equal to half a value of a supply voltage.

15. A memory device comprising:

a matrix of memory cells;

a selection circuit configured to select a first group of memory cells of said matrix of memory cells by biasing the first group with a first voltage during a reading operation;

a write circuit configured to program a second group of memory cells of said matrix of memory cells by biasing the second group with a second voltage during a programming operation;

a charge pump configured to generate a pump voltage; and a voltage regulator comprising an input terminal coupled to said charge pump and configured to receive the pump voltage, a first output terminal coupled to said selection circuit and configured to provide the first voltage, a second output terminal coupled to said write circuit and configured to provide the second voltage, a first amplifier, a regulation transistor having a first conduction terminal coupled to said first amplifier, a second conduction terminal, and a control terminal coupled to an output of said first amplifier, a voltage divider circuit comprising first and second terminals, said second terminal of said voltage divider circuit coupled to said second conduction terminal of said regulation transistor and configured to provide a regulation voltage thereto in cooperation with a current generated by said regulation transistor, and a compensation circuit coupled to said control terminal of said regulation transistor and configured to provide a compensation voltage in response to variations of the regulation voltage.

16. The memory device of claim 15 wherein said compensation circuit is configured to:

decrease the compensation voltage in response to an increase of the regulation voltage; and increase the compensation voltage in response to a decrease of the regulation voltage.

17. The memory device of claim 16 wherein said compensation circuit comprises a second amplifier having a first input terminal configured to receive a first reference voltage, a second input terminal coupled to said first terminal of said voltage divider circuit and configured to receive a second reference voltage, and an output terminal coupled to said control terminal of said regulation transistor and configured to provide the compensation voltage.

18. The memory device of claim 17 wherein said compensation circuit further comprises a capacitor having a first terminal coupled to said output terminal of said second amplifier, and a second terminal coupled to said control terminal of said regulation transistor.

19. A method of making a voltage regulator comprising:

coupling a regulation transistor having a first conduction terminal coupled to a first amplifier, a second conduction terminal, and a control terminal coupled to an output of the first amplifier;

providing a voltage divider circuit comprising first and second terminals;

coupling the second terminal of the voltage divider circuit to the second conduction terminal of the regulation transistor and to provide a regulation voltage thereto in cooperation with a current generated by the regulation transistor; and coupling a compensation circuit to the control terminal of the regulation transistor and to provide a compensation voltage.

20. The method of claim 19 further comprising configuring the compensation circuit to:

decrease the compensation voltage in response to an increase of the regulation voltage; and increase the compensation voltage in response to a decrease of the regulation voltage.

21. The method of claim 20 further comprising forming the compensation circuit to comprise a second amplifier having a first input terminal to receive a first reference voltage, a second input terminal coupled to the first terminal of the voltage divider circuit for receiving a second reference voltage, and an output terminal coupled to the control terminal of the regulation transistor for providing the compensation voltage.

22. The method of claim 21 further comprising forming the compensation circuit to comprise a capacitor having a first terminal coupled to the output terminal of the second amplifier, and a second terminal coupled to the control terminal of the regulation transistor.

23. The method of claim 21 wherein a common mode biasing voltage of the second amplifier is substantially equal to half a value of a supply voltage.

* * * * *

UNITED STATES PATENT AND TRADEMARK OFFICE

CERTIFICATE OF CORRECTION

PATENT NO. : 8,902,678 B2
APPLICATION NO. : 13/405619
DATED : December 2, 2014
INVENTOR(S) : Dimartino et al.

It is certified that error appears in the above-identified patent and that said Letters Patent is hereby corrected as shown below:

In the Claims

Column 13, Line 1 Delete: "output terminal output"
Insert: --output terminal--

Signed and Sealed this
Fourth Day of August, 2015

Michelle K. Lee

Michelle K. Lee
*Director of the United States Patent and Trademark Office*